United States Patent [19]

Lawson

[11] Patent Number: 5,076,118

[45] Date of Patent: Dec. 31, 1991

[54] FUSE INSERTION OR REMOVAL TOOL

[75] Inventor: Robert P. Lawson, Snellville, Ga.

[73] Assignee: Siemens Energy & Automation, Inc., Alpharetta, Ga.

[21] Appl. No.: 584,236

[22] Filed: Sep. 18, 1990

[51] Int. Cl.[5] ..... B25B 27/14

[52] U.S. Cl. ..... 81/3.8

[58] Field of Search ..... 81/3.8; 29/756, 758

[56] References Cited

U.S. PATENT DOCUMENTS

| | | | |
|---|---|---|---|
| 1,741,222 | 12/1929 | Brown | 81/3.8 |
| 2,243,528 | 5/1941 | Grinnell | 81/3.8 |
| 3,194,926 | 7/1965 | Ustin | 200/133 |
| 3,518,599 | 6/1970 | Lanux | 337/186 |
| 3,896,408 | 7/1975 | Leidy, Jr. | 337/211 |
| 3,973,318 | 8/1976 | Strachan | 29/437 |
| 4,094,212 | 6/1978 | Hyams et al. | 81/3.8 |
| 4,107,639 | 8/1978 | Levy | 337/205 |
| 4,128,024 | 12/1978 | Hyams et al. | 81/3.8 |
| 4,288,138 | 9/1981 | Berry et al. | 339/147 |
| 4,302,643 | 11/1981 | Cox et al. | 200/144 |
| 4,314,383 | 2/1982 | Epstein | 7/170 |
| 4,321,576 | 3/1982 | Lien | 337/202 |
| 4,414,698 | 11/1983 | Epstein | 7/170 |
| 4,429,936 | 2/1984 | Rusenko et al. | 339/45 |
| 4,475,283 | 10/1984 | Olson et al. | 29/720 |
| 4,671,588 | 6/1987 | Fritsch et al. | 439/160 |
| 4,696,528 | 9/1987 | Harnois | 439/160 |

*Primary Examiner*—Roscoe V. Parker

*Attorney, Agent, or Firm*—Peter A. Luccarelli, Jr.

[57] ABSTRACT

A tool (10) for insertion or removal of generally elongated fuses (32), which has a body portion (12) for capture of the fuse (32) about its circumference, including a base (14), a foot (16), a side member (18) and a top (20). The tool (10) may have axle stubs (17) that are rotatively engageable in apertures (54) defined by fuse holder pan well (52). The tool (10) also has a tab (b 22) attached to the body (12) for rocking the fuse (32) about a fulcrum axis defined by contact of the foot (16) with the floor (36) of a fuse holder pan or by rotation of axle stubs (17) within apertures (54) defined by the sidewalls (56). The tool (10) may have a positioning rib (24) attached to the body (12) for limiting axial movement of the fuse (32) relative to the tool (10). The top (20) may serve as a cover for a fuse holder pan (34).

21 Claims, 3 Drawing Sheets

FUSE INSERTION OR REMOVAL TOOL

BACKGROUND OF THE INVENTION

The present invention relates to tools for the installation or removal of fuses from biased fuse clips which are located in fuse holder pans. Such tools are often referred to as fuse pullers.

The installation or removal of a cylindrical fuse, such as a barrel fuse, from biased fuse clips, which are also known as contact sets, located within a fuse holder pan requires overcoming the contact bias force generated by the contact sets during fuse positioning. Tight clearances around the fuse well may prevent an electrician from establishing a good grasp of the fuse barrel necessary to counteract the fuse clip bias force.

Over the years, devices have been created to aid electricians with fuse removal and some of the devices also aid an electrician with installation of fuses. Tools of the type which aid electricians with fuse installation and removal include clip-on type pullers that are used to grasp the fuse barrel between the fuse clips, or pliers having c-shaped jaws which grasp the fuse barrel. Another type of installation aid has been a shrouded injector/ejector assembly, which holds the fuse and which inserts or ejects as a spring-loaded cartridge. Other types of tools can be used to remove fuses, but cannot be used to install fuses. Such types of fuse pullers include ejector levers, which include a pivoting lever that contacts the fuse barrel or loop-type fuse pullers which encircle the fuse barrel or contact and ride in a track built within the fuse well or fuse contact.

The prior known fuse pulling and/or installation tools have disadvantages. Clip-on and plier-type fuse pullers are not an integral part of the fuse assembly and may be misplaced, or the electrician may not have the tool handy when needed to replace or install a fuse. The loop- and lever-type tools are not helpful for fuse installation, thus the electrician must maneuver and urge the fuse assembly into the biased fuse clips without a grasping tool, often in tight, cramped quarters. The loop-type and levertype pullers also tend to require more clearance space for the extra components than may otherwise be available in an installation environment. Loop-type and lever-type fuse pullers as well as the shrouded injector/ejector-type assemblies cannot be retrofitted into existing fuse holder wells which were not originally designed to accept such tools without reconstructing the fuse holder.

It is an object of the present invention to create a fuse insertion and removal tool which can be utilized in existing fuse holder wells without retrofit conversion.

It is another object of the present invention to create a fuse insertion and removal tool which mounts securely within existing fuse holder wells with no guides, detents, or special fasteners.

It is an additional object of the present invention to create a fuse insertion or removal tool which provides an insulating cover over the fuse.

It is also an object of the present invention to create an inexpensive one-piece design fuse insertion or removal tool that can be left within a fuse well.

It is another object of the present invention to create a fuse insertion or removal system having a fuse holder well which retains the fuse insertion or removal tool within the fuse well.

SUMMARY OF THE INVENTION

The objects have been attained by the tool of the present invention for insertion or removal of generally elongated fuses having a circumference, such as, for example, ferrule or blade-type fuses, into fuse clips or contact sets located within a fuse holder pan, comprising a body portion for capture of a fuse barrel about the circumference, the body having a base, a foot defined by the base, a top generally parallel to and spaced away from the base, and at least one side member connected to the base and top. The tool of the present invention also has a tab attached to the body for rocking the fuse about a fulcrum axis defined by contact of the foot with the fuse holder pan, so as to position the fuse within fuse clips located within the fuse holder pan. The tool also has a positioning rib attached to the body generally along the top.

In some embodiments of the present invention, the tool has a body portion having a generally c-shaped cross section for capture of a fuse barrel about the circumference thereof, the body portion having a base, a foot defined by the base, a side member attached generally perpendicularly to the base, and a top attached generally perpendicularly to the side member and generally parallel to the base. In this embodiment, the tool has a tab attached to the body generally along the top for rocking the fuse about a fulcrum axis defined by contact of the foot with the fuse holder pan, so as to position the fuse within fuse clips located within the fuse holder pan.

Another embodiment of the present invention is a system for insertion or removal of generally elongated fuses having a circumference comprising a fuse holder pan well having a floor, two sidewalls and having at least one aperture in each sidewall; a pair of biased fuse clip sets attached to the fuse holder pan well for electrical coupling to ends of a fuse inserted therein. The tool has a body portion having a generally c-shaped cross section for capture of a fuse barrel about the circumference thereof that is insertable into the well. The body portion has a base, a foot defined by the base, an axle attached to the foot with axle stubs that are rotatively engageable in the wall apertures, a side member attached generally perpendicularly to the base, and a top for covering the well, attached generally perpendicularly to the side member and generally parallel to the base. In this embodiment, the tool has a tab attached to the body for rocking the fuse about a fulcrum axis defined by rotation of the axle within the fuse holder pan well, so as to position the fuse within the contact sets located within the well. The body portion may have a positioning rib attached to the body generally along the top and projecting generally toward the base for limiting axial travel of the fuse barrel relative to the body portion.

DESCRIPTION OF THE PREFERRED EMBODIMENTS

Figure 1:
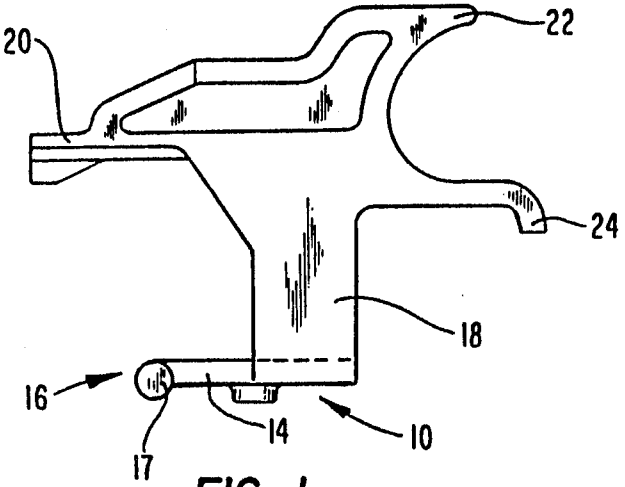
FIG. 1 is a side-elevational view of the fuse insertion or removal tool of the present invention.
Figure 2:
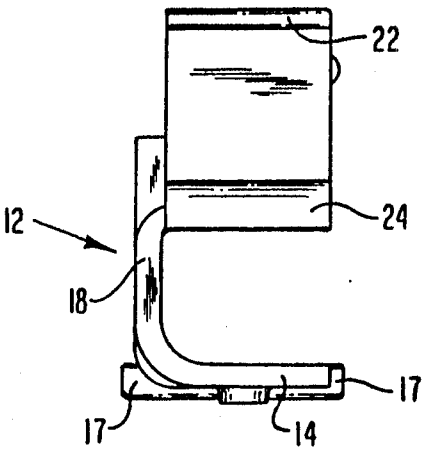
FIG. 2 is a front-elevational view of the invention of FIG. 1.
Figure 3:
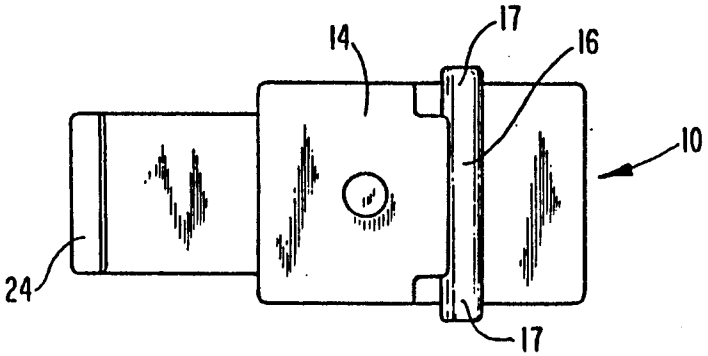
FIG. 3 is a bottom-plan view of the invention of FIG. 1.

The fuse insertion or removal tool of the present invention is shown generally in FIGS. 1-3. The tool 10 has a body portion 12, which as shown in FIG. 2 has a generally c-shaped cross section. The body portion 12 has a base 14 with a foot 16 defined by the base 14. The foot 16 preferably has a round, axle-like cross section having axle stubs 17 which project laterally from both sides of the base 14.

The body portion 12 has a side member 18 which is connected generally perpendicularly to the base 14. The body portion 12 also has a top 20 attached generally perpendicularly to the side member 18 and generally parallel to the base 14. The tool 10 has a finger tab 22 attached to the body portion 12 along the top 20. The tool 10 also has a positioning rib 24 attached to the body portion 12 along the top 20.

The fuse insertion or removal tool of the present invention preferably has a unitary construction of plastic or other suitable non-conducting material, and preferably thermoplastic material. A suitable plastic for constructing the tool according to the present invention is DELRIN 570, manufactured by DuPont. The preferable technique for manufacturing the tool of the present invention is by plastic molding, though alternatively, the tool may be manufactured by an extrusion process or formed by joining a combination of molded and extruded components.

Figure 4:
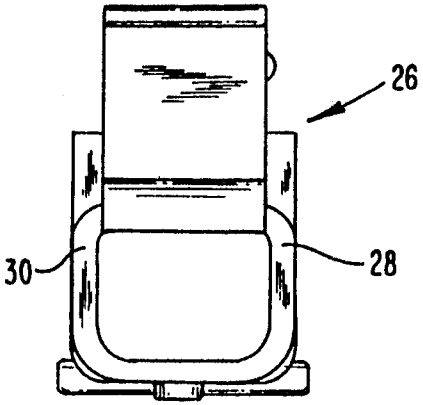
FIG. 4 is a front-elevational view of another embodiment of the present invention.

An alternate embodiment of the fuse puller tool of the present invention is shown in FIG. 4, wherein the body portion 26 has a pair of side members 28 and 30.

Figure 5:
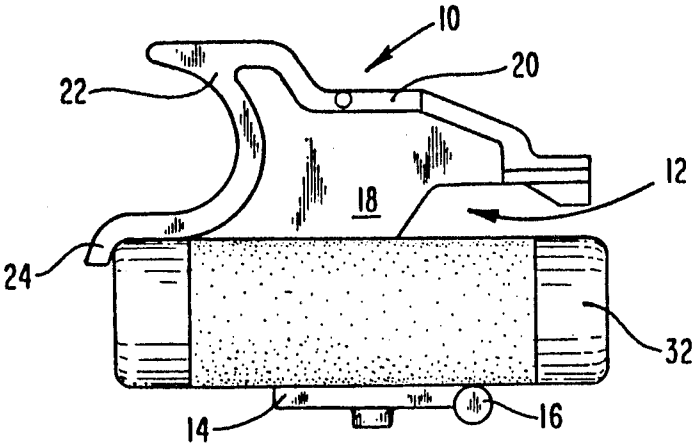
FIG. 5 is a side-elevational view of the present invention, showing a barrel fuse inserted in the tool.

The tool of the present invention is used by inserting a fuse, such as the barrel fuse 32 shown in FIG. 5, into the c-shaped body portion 12 of the tool. In the embodiment shown in FIG. 5, the fuse 32 is retained snugly in the body portion 12 due to the biasing action of the top 20 and base 14. However, the tool 10 may also be constructed so that fuse 32 fits loosely within the c-shaped body portion 12. As also shown in FIG. 5, the rib 24 limits axial movement of fuse 32 relative to the body portion 12. When the fuse 32 contacts the rib 24, there can be no further leftward movement of the fuse.

Figure 6:
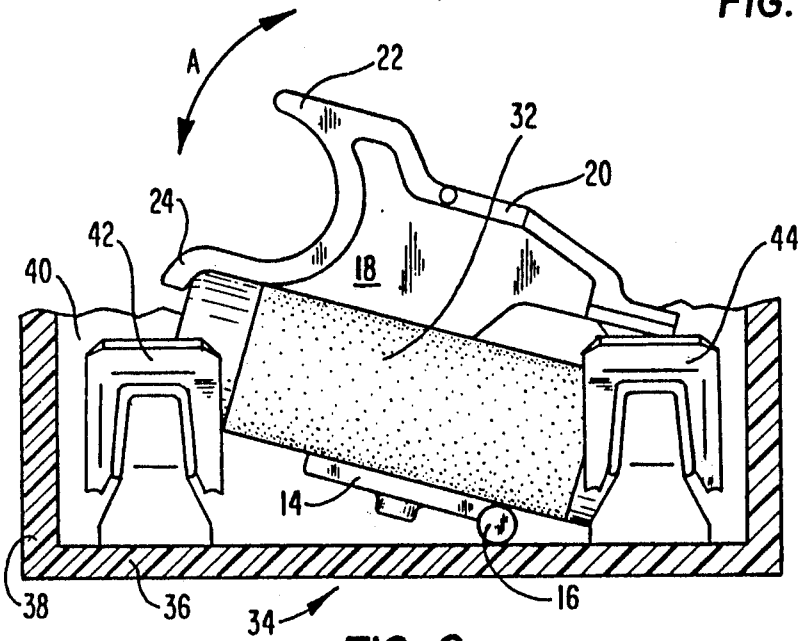
FIG. 6 is a fragmented side-elevational schematic view of a fuse holder pan well showing use of the present invention for removal or insertion of a barrel-type fuse from or into the well, respectively.
Figure 7:
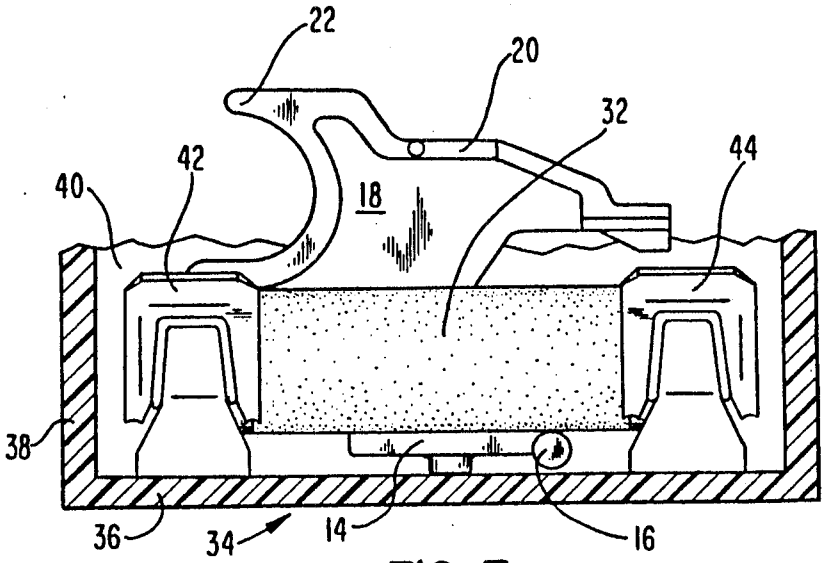
FIG. 7 is a fragmented side-elevational schematic view of a fuse holder pan well with a barrel fuse fully inserted therein with the tool of present invention.

FIGS. 6 and 7 show utilization of the tool of the present invention for installation or removal of a fuse, such as barrel fuse 32 with ferrule-type contacts into a fuse well 34 of a fuse holder pan. As shown schematically in those figures, the fuse holder pan well 34 has a floor 36, a pair of endwalls 38 and a sidewall 40. The other sidewall has been cut away for clarity. The fuse holder pan well 34 also has a pair of biased fuse clips 42 and 44 which each comprise a pair of opposed leaf springs that capture conductive ends of the barrel fuse 32 between the leaf springs. It should be understood that the fuse holder pan 34 shown in FIGS. 6 and 7 is a generic schematic representation of such pans which could be incorporated in other devices, such as switch assemblies or the like. While FIGS. 6 and 7 show utilization of the tool 10 of the present invention with a barrel fuse having ferrule-type contacts, it should be understood to those skilled in the art that the tool of the present invention can be utilized in connection with other types of elongated fuses, including without limitation barrel fuses with blade-type contacts.

As shown in FIG. 6, the foot 16 contacts the floor 36 of the pan and establishes a fulcrum axis which is normal to the drawing (i.e., in and out of the drawing sheet) and a leverage moment is provided by manipulation of the finger tab 22 about the rotational path shown by arrow A. For example, when removing a fuse, the finger tab 22 shown in FIG. 6 is rocked in a generally clockwise direction, which urges the left end of fuse 32 out of engagement with the biased fuse clip 42 leaf springs. When the tool is rocked sufficiently in a clockwise direction to free the left end of fuse 32 from the fuse clip 42, the left side of the fuse can be grabbed by the technician and pulled axially in a generally leftwardly direction, thus disengaging the right end of fuse 32 from the fuse clip 44.

In order to install a fuse 32 into the fuse holder pan well 34, it is inserted into the tool 10, as shown in FIG. 5. The right end of fuse 32 is inserted into the fuse clip 44 by downward pressure on the finger tab 22. Rib 24 contacts the left end of fuse 32 and prevents the tool 10 from sliding off the fuse 32 toward the right. Once the right end of fuse 32 is engaged in the fuse clip 44 leaf springs, the finger tab 22 is rocked in a generally counter- clockwise direction, so as to urge the left end of the fuse 32 into engagement within the fuse clip 42 leaf springs. The rib 24 prevents excessive counterclockwise rotation of fuse 32 into the fuse clip 42 by abutting the top edge of that fuse clip when the fuse 32 is fully engaged within the fuse clip 42 leaf springs.

As shown in FIG. 7, the insertion or removal tool 10 of the present invention may be left in place during fuse operation and desirably, the top cover 20 is dimensioned to cover a substantial portion of the fuse well 34, and particularly the fuse 32, so that it is utilized as a fuse cover during fuse operation. However, if desired, and if there is sufficient lateral clearance within the fuse well, the insertion and removal tool 10 of the present invention may be removed after fuse installation by sliding it in radially relative to the fuse central axis in direction which would be into the drawing sheet of FIG. 7, if there is sufficient lateral clearance within the fuse well to allow tool removal.

Figure 9:
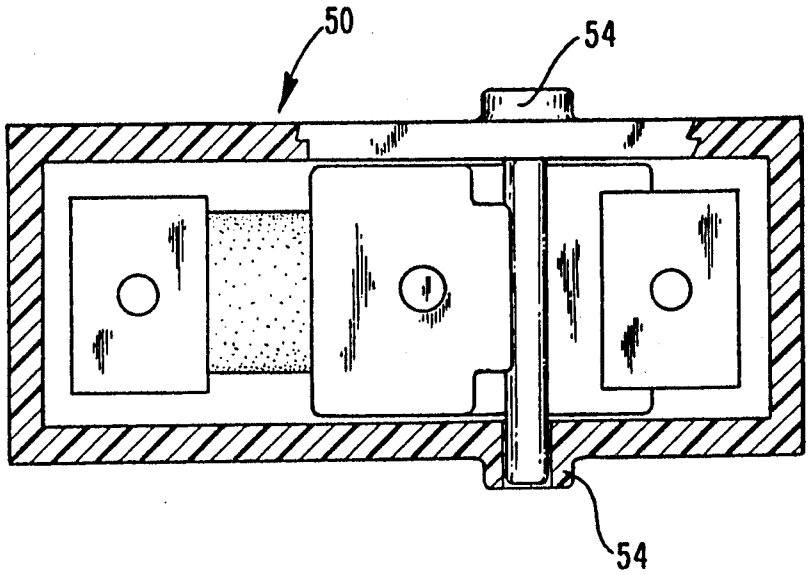
FIG. 9 is a top-plan schematic view of the system of FIG. 8.
Figure 8:
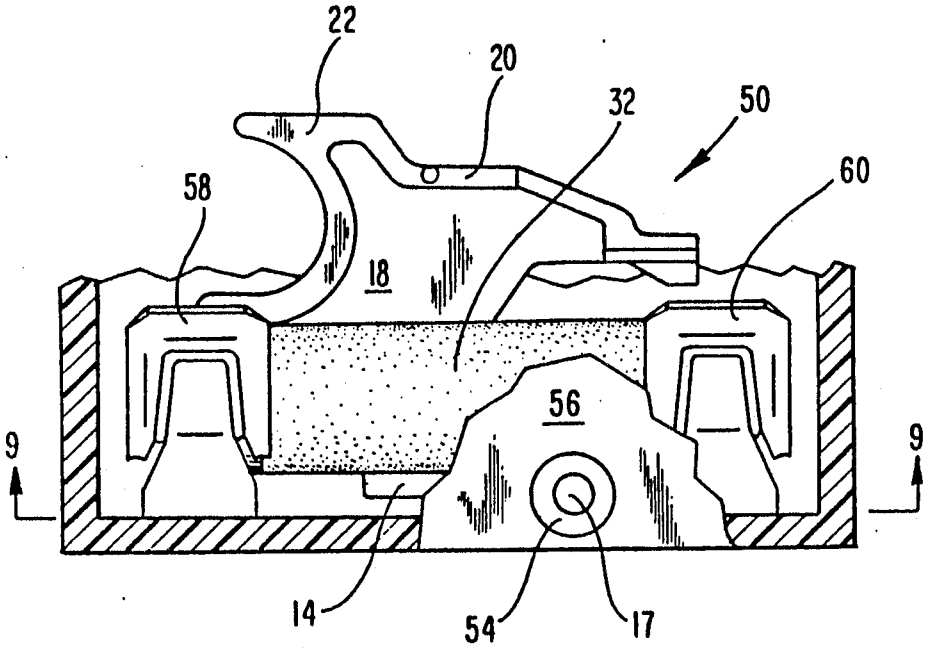
FIG. 8 is a fragmented side-elevational schematic view of a fuse insertion or removal system of the present invention with a barrel fuse fully inserted therein.

FIGS. 8 and 9 show schematically a fuse insertion and removal system 50 having a fuse holder pan well 52 which is designed to engage the fuse insertion and installation tool 10 axle stubs 17 in apertures 54 which are defined by the fuse holder pan well sidewalls 56. The fuse holder pan well 52 has fuse clip sets 58 and 60 for retention of the barrel fuse 32 or other type of elongated fuse. As with FIGS. 6 and 7, the fuse holder pan well 52 shown in FIGS. 8 and 9 should be understood to be a generic schematic representation of such pans, which could be incorporated in other devices, such as switch assemblies and the like.

The fuse insertion and removal system embodiment shown in FIGS. 8 and 9 is used in the same manner as described above with respect to FIGS. 6 and 7, except that the fulcrum axis is defined by rotation of the axle stubs 17 within the apertures 54 of sidewalls 56.

The foregoing description of the preferred embodiments is intended to illustrate without limitation the present invention. It is understood, of course, that changes and variations can be made therein without departing from the scope of the invention which is defined in the following claims.

What is claimed is:

1. A tool for insertion or removal of generally elongated fuses having a circumference into fuse clips located within a fuse holder pan comprising:

a body portion for capture of a fuse barrel about the circumference thereof, the body portion having a base, a foot defined by the base, a top generally parallel to and spaced away from the base, and at least one side member connected to the base and top;

a tab attached to the body for rocking the fuse about a fulcrum axis defined by contact of the foot with the fuse holder pan, so as to position the fuse within fuse clips located within the fuse holder pan; and a positioning rib attached to the body generally along the top.

2. The tool of claim 1, wherein the body portion is dimensioned for biased retention of the fuse barrel about at least a portion of the circumference thereof.

3. The tool of claim 1, wherein the body and positioning rib are dimensioned for insertion into a fuse holder pan well.

4. The tool of claim 1, wherein the positioning rib projects toward the base for limiting axial travel of the fuse relative to the body portion.

5. The tool of claim 1, wherein the tool has a unitary construction.

6. The tool of claim 1, wherein the tool is constructed of plastic.

7. The tool of claim 1, wherein the foot has an axle with axle stubs that are rotatively engageable in apertures defined by the fuse holder pan for defining the fulcrum axis.

8. A tool for insertion or removal of generally elongated fuses having a circumference into fuse clips located within a fuse holder pan comprising:

a body portion having a generally c-shaped cross section for capture of a fuse barrel about the circumference thereof, the body portion having a base, a foot defined by the base, a side attached generally perpendicularly to the base and a top attached generally parallel to the base;

a tab attached to the body generally along the top for rocking the fuse about a fulcrum axis defined by contact of the foot with the fuse holder pan, so as to position the fuse within fuse clips located within the fuse holder pan; and a positioning rib attached to the body which projects toward the base for limiting axial travel of the fuse relative to the body portion.

9. A tool for insertion or removal of generally elongated fuses having a circumference into fuse clips located within a fuse holder pan comprising:

a body portion having a generally c-shaped cross section for capture of a fuse barrel about the circumference thereof, the body portion having a base, a foot defined by the base having an axle with axle stubs that are rotatively engageable in apertures defined by the fuse holder pan, a side attached generally perpendicularly to the base and a top attached generally parallel to the base; and a tab attached to the body generally along the top for rocking the fuse about a fulcrum axis defined by rotation of the axle within the fuse holder pan, so as to position the fuse within fuse clips located within the fuse holder pan.

10. A system for insertion or removal of generally elongated fuses having a circumference comprising:

a fuse holder pan well having a floor, two sidewalls and at least one aperture in each sidewall;

a pair of biased fuse clips attached to the fuse holder pan well for electrical coupling to ends of a fuse inserted therein;

a body portion having a generally c-shaped cross section for capture of a fuse barrel about the circumference thereof that is insertable into the well, the body portion having a base, a foot defined by the base, an axle attached to the foot with axle stubs that are rotatively engageable in the wall apertures, a side member attached generally perpendicularly to the base, and a top for covering the well, attached generally perpendicularly to the side member and generally parallel to the base; and a tab attached to the body generally along the top for rocking the fuse about a fulcrum axis defined by rotation of the axle within the fuse holder pan well, so as to position the fuse within the fuse clips located within the well.

11. The system of claim 10, wherein the body portion is dimensioned for biased retention of the fuse barrel about at least a portion of the circumference thereof.

12. The system of claim 10, wherein the tool has a unitary construction.

13. The system of claim 10, wherein the tool is constructed of plastic.

14. The system of claim 10, wherein the tool is constructed of molded plastic.

15. The system of claim 10, wherein the tool is constructed of extruded plastic.

16. The system of claim 10, wherein the body portion has a positioning rib attached to the body and projecting generally toward the base for limiting axial travel of the fuse barrel relative to the body portion.

17. A system for insertion or removal of generally elongated fuses having a circumference comprising:

a fuse holder pan well having a floor, two sidewalls and at least one aperture in each sidewall;

a pair of biased fuse clips attached to the fuse holder pan well for electrical coupling to ends of a fuse inserted therein;

a body portion having a generally c-shaped cross section for capture of a fuse barrel about the circumference thereof that is insertable into the well, the body portion having an axle attached to the body with axle stubs that are rotatively engageable in the wall apertures, and a top for covering at least a portion of the well; and a tab attached to the body generally along the top for rocking the fuse about a fulcrum axis defined by rotation of the axle within the fuse holder pane well, so as to position the fuse within the fuse clips located within the well.

18. The system of claim 17, wherein the body portion is dimensioned for biased retention of the fuse barrel about at least a portion of the circumference thereof.

19. The system of claim 17, wherein the tool has a unitary construction.

20. The system of claim 19, wherein the tool is constructed of plastic.

21. The system of claim 17, wherein the body portion has a positioning rib for limiting axial travel of the fuse barrel relative to the body portion.

* * * * *